US005381568A

United States Patent [19]

Warkentin

[11] Patent Number: 5,381,568

[45] Date of Patent: Jan. 17, 1995

[54] INSTANT TISSUE MOISTENER

[76] Inventor: Herman S. Warkentin, 6021 Shelton St., Fort Worth, Tex. 76112

[21] Appl. No.: 152,419

[22] Filed: Nov. 16, 1993

[51] Int. Cl.[6] ..... E03D 9/00

[52] U.S. Cl. ..... 4/661; 4/341

[58] Field of Search ..... 4/224, 225.1, 227.1, 4/227.3, 227.4, 227.5, 227.6, 228.1, 300.1, 341, 340, 342, 363, 661; 118/265, 266, 270

[56] References Cited

U.S. PATENT DOCUMENTS

| | | | |
|---|---|---|---|
| 958,149 | 5/1910 | Metzner | 118/265 |
| 1,786,513 | 12/1930 | Zuckerman | 4/341 X |
| 2,152,682 | 4/1939 | Dwofsky | 118/265 |
| 2,466,144 | 4/1949 | Adams | 4/341 |
| 2,876,735 | 3/1959 | Link | 118/266 |
| 3,083,374 | 4/1963 | Watlington | 4/300.1 X |
| 3,326,180 | 6/1967 | Lofgren | 118/270 X |

*Primary Examiner*—Robert M. Fetsuga

[57] ABSTRACT

This disclosure presents a system that provides small but adequate portions of water to a folded or crumpled pad of bathroom tissue for use in giving added comfort and cleansing to anal skin surfaces after evacuation. The system uses only pure, municipal, or equivalent water, or other compatible fluid, and the process is quickly and comfortably performed within easy reach of the user. This device is intended to be installed in and operated in conjunction with most flush type toilet tanks. The device uses available water pressure sad is supplied with water by the normal flushing cycle of the toilet. Types of fluids, other than water may be transported by this system by selecting component materials of the same or similar physical properties that are compatible with the fluid being transported, and may be adapted to situations other than bathroom toilet tanks.

3 Claims, 2 Drawing Sheets

INSTANT TISSUE MOISTENER

BACKGROUND OF THE INVENTION

1. Field of the Invention

The present invention relates to providing improved bodily cleanliness following evacuation and to reduce irritation and/or infection of the sensitive anal skin surfaces. The device provides instant wetting of folded or crumpled bath tissue in a convenient manner. This invention relates in general to 4/222 and is similar in appearance to U.S. Pat. No. 4,209,863, however, the function of the earlier patent is to chemically treat the water in the toilet tank and the surrounding air for improved soil and odor control. The function of the present invention is to assist in safely protecting and cleansing anal skin surfaces, This device is novel in providing this function in the manner described herein.

2. Prior Art

It is presently common practice to moisten a tissue pad by holding it under a lavatory faucet or a bath tub faucet. This is unhandy if the faucet is not within reach and it is difficult to control the tissue wetness. No device is known that provides controlled moistening of tissue pads in the manner described of the present invention, moistening only the middle portion of the tissue pad.

SUMMARY OF THE INVENTION

The principal object of the present invention is to provide a device that will deliver a small amount of clean water or other fluid, at ambient temperature to a folded or crumpled pad of bathroom tissue or a similar pad, in a manner by which the tissue wetness can be controlled and with the wetting component being within easy reach of the person using it. Although bathroom tissue is being produced in compositions that are as nonirritating as is practical, moistened tissue is significantly less irritating and also provides added cleansing of the anal skin tissue. Well known physicians recommend washing these skin areas after evacuation, in addition to using dry tissue, to help prevent infection. The system can be used also for dispensing slow dissolving medication from the fresh water reservoir to the tissue pad.

The device is so arranged that water or other fluid is supplied directly from the antisiphon discharge hose or other suitable source to the fresh-water reservoir and does not use water from the toilet tank which may hold bowl cleaning compounds in suspension that could cause severe injury to anal skin surfaces.

The device is comprised of relatively easily manufactured components and is readily assembled and installed in most toilet water tanks. The device is installed so that the moistening dispenser is in view of the user but is not objectionable and is activated simply by pressing a folded or crumpled pad of tissue, or a similar pad, against the foam pad attached to the outer surface of the dispenser. The amount of wetness is controlled by the number of times the tissue is pressed against the dispenser.

BRIEF DESCRIPTION OF THE DRAWINGS

For a more complete understanding of the present invention and the advantages thereof, reference is now made to the following descriptions.

DETAILED DESCRIPTION

Figure 1:
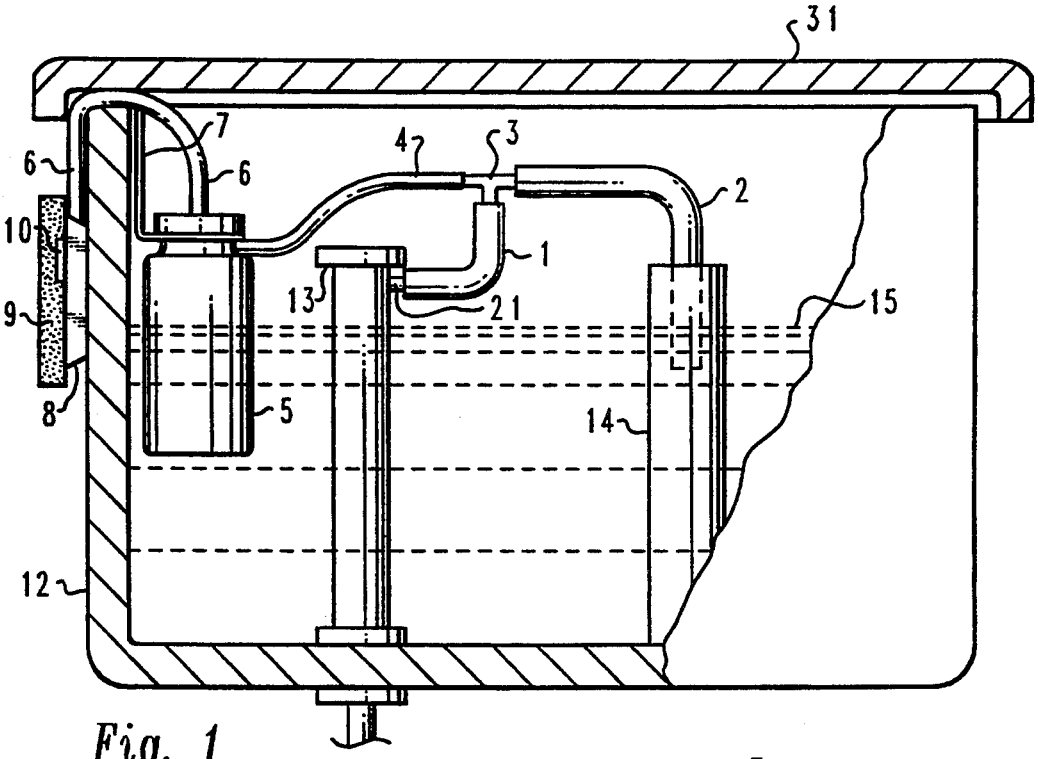
FIG. 1 is a front view of a flush-type toilet tank with a cut-a-way view of the front tank wall exposing the comprised .parts and components of the device.

With reference now to the figures wherein like reference characters designate like parts throughout the several views. FIG. 1 is a front view of the system comprising the required parts. The process of transporting the water or other fluid begins at the antisiphon valve toilet bowl refill outlet 21 which is a standard part of the toilet antisiphon inlet valve 13 and is activated at every flush of the toilet, supplying an adequate amount of water from the city water supply or a similar source, to fill the tank reservoir and bowl. The use of water from the vacuum-breaker incorporated in the tank inlet valve, also prevents backflow from the moistening system into the city water supply as is required in accordance with the National Standard Plumbing Code 10.5.1 and 10.5.2 © 1980 and the National Plumbing Code 10.5.1 and 10.5.2 © 1968.

Tube 1 which is part of the assembled moistening system is connected to the antisiphon outlet 21 and to the side element of the tee connector 3. Tube 2, which is part of the moistening system, is attached to one end element of the tee connector 3 and extended into the antisiphon drain 14, which is a standard part of the toilet tank assembly 12. Tube 4 extends from the other end element of the tee connector 3 to an inlet hole 26 near the top of reservoir 5.

After filling reservoir 5, any excess fluid overflows through the overflow hole 23. A flow restrictor may be used if a reduced flow rate to reservoir 5 is desired. The reservoir check valve 11 allows flow from the lower area of the reservoir 5 into tube 6 and into dispenser 8. Dispenser 8 is a diaphragm type pump unit having a resilient front face 20 and a back face 27 which is substantial enough for attaching it to a rigid surface by cementing or other means. The front and back faces 20 and 27 respectively, are attached to each other, or fabricated as a unit, so as to form a leak proof joint forming a cavity between them. A fluid inlet to the dispenser 8 is provided by tube 6 inserted through hole 28 in the edge of dispenser 8. Check valve 10 incorporated in the front face of dispenser 8 allows fluid to flow outwardly from the dispenser cavity, through a relatively small hole 24 in front face 20 into the open cell foam pad 9 which is attached to ,the outside of the front face 20 of dispenser 8. When dispenser 8 is activated, fluid is pushed through check valve 10 and into foam pad 9. Front face 20 of dispenser 8 is of thin resilient material acting as a diaphragm. Pressing against front face 20 forces fluid out through dispenser check valve 10. Releasing force on front face 20 draws fluid from reservoir 5 through check valve 11, through tube 6 and into dispenser 8. Wire hanger 7 supports reservoir 5 on tank wall 12. Hanger 7 in combination of it's proper length with the proper length of tube 6 locates the proper levels of reservoir 5 and dispenser 8 for proper operation of the system and prevents any water from tank 12 to enter reservoir 5.

Figure 2:
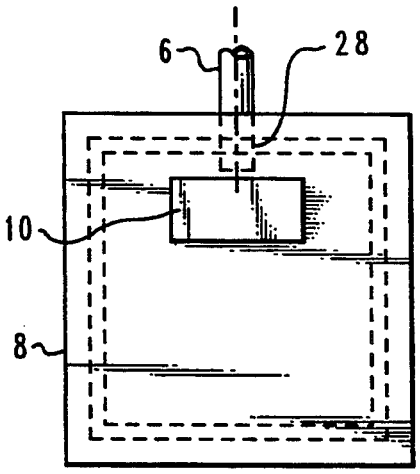
FIGS. 2 and 3 are views of the dispenser including the dispenser check valve and a portion of the dispenser supply tube from the reservoir.
Figure 3:
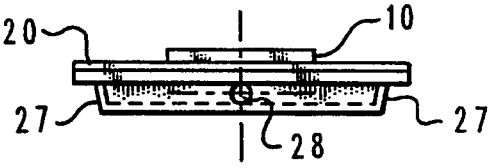

FIGS. 2 and 3 are enlarged views showing a front view of dispenser 8 showing the location of check valve 10 and tube 6 installed through hole 28.

Figure 4:
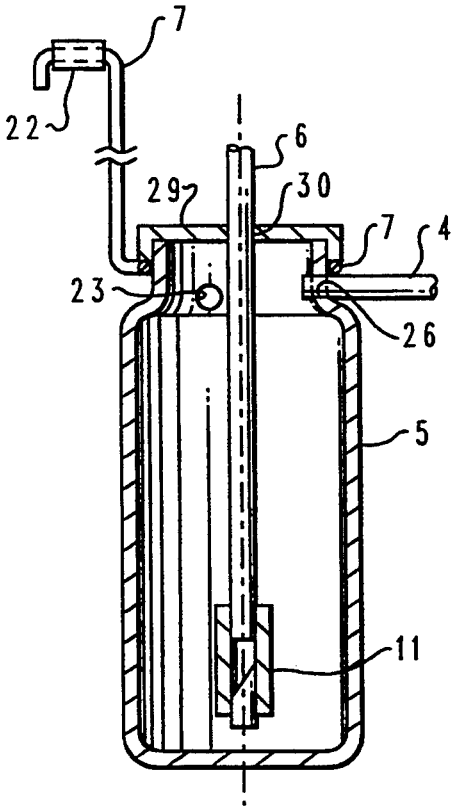
FIG. 4 is a cut-a-way view of the-reservoir including the reservoir check valve and portions of the fresh water tube from the tee connector and the tube from the reservoir check valve to the dispenser.

FIG. 4 is a cross-section of reservoir 5 showing the installation of tube 4 from one end element of tee connector 3 into reservoir 5, the installation of tube 6 with check valve 11 attached and tile installation of wire hanger 7. Tube 4 is installed into hole 26 in the neck of reservoir 5. Tube 6 is installed into hole 30 in reservoir lid 29. Wire hanger 7 is looped aroung neck of reservoir 5 and is installed under, and held in place by reservoir lid 29. Excess fluid from tube 4 overflows from reservoir 5 through hole 23 into toilet tank 12. Hanger 7 incorporates tube 22 which provides clearance under tank lid 31 to prevent crushing tube 6.

Figure 5:
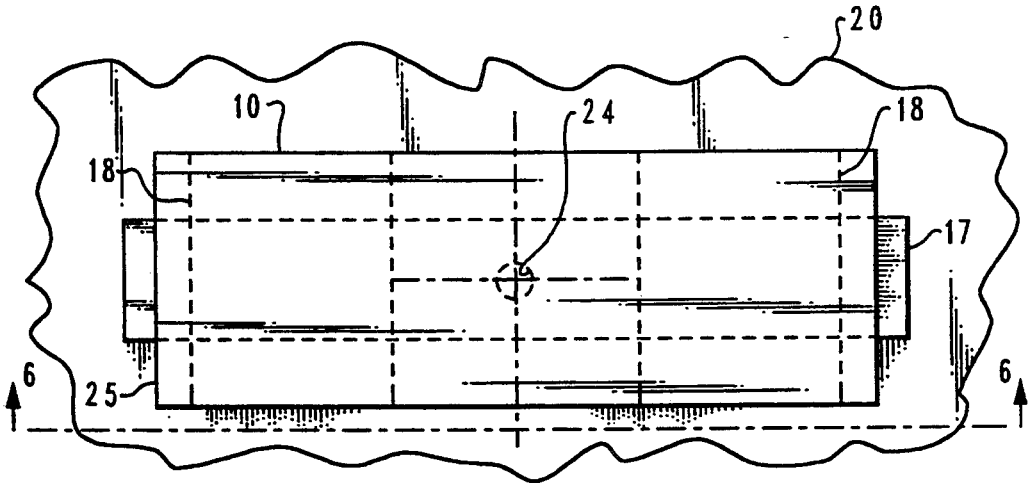
FIGS. 5 and 6 are an enlarged view and a side view of the dispenser check valve as it is installed on the dispenser outer face.
Figure 6:
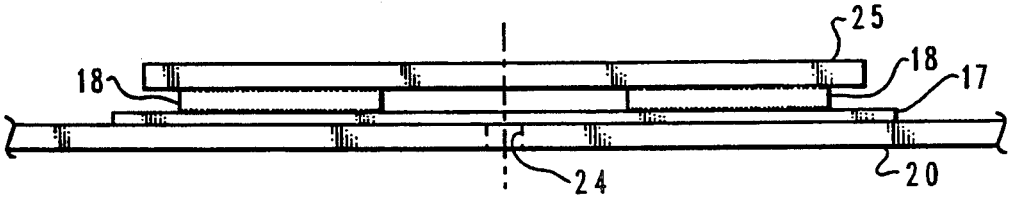

FIGS. 5 and 6 are enlarged views of dispenser check valve 10 showing membrane 17. Adhesive strips 18, cover plate 25 and hole 24 through front face 20. Adhesive strips 18 are of adequate thickness to offset cover plate 25 from front face 20 and allow opening of membrane 17 from hole 24, thus allowing fluid to flow out of dispenser 8. Release of the force on outer face 20 causes a negative pressure within dispenser 8, drawing membrane 17 against front face 20, to close hole 24, to block the back-flow and to draw fluid into dispenser 8 from reservoir 5, through check valve 11.

Figure 7:
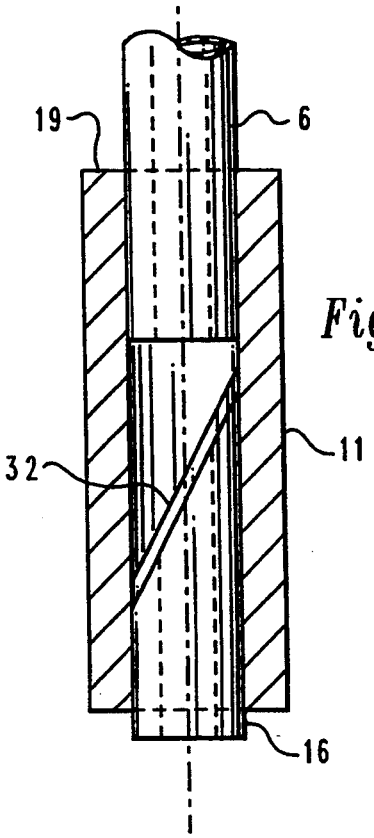
FIGS. 7 and 8 present front and side views of the reservoir check valve showing the tube element having an elongated, diagonal cut, valve face.
Figure 8:
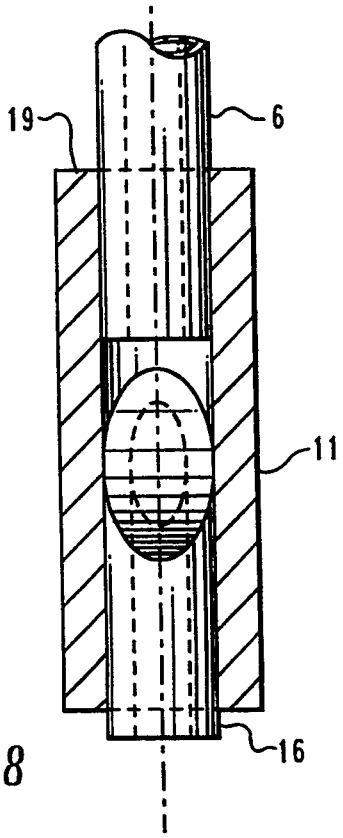

FIGS. 7 and 8 show a side view and a front view of check valve 11. The side view shows the elongated diagonal cut of tube 16 and tile loosely placed membrane 32 over the elongated face of valve 16. The front view shows the elliptical shape of valve face 16 as it is installed in close fitting larger tube 19. Tube 6 is installed into tube 19 so that membrane 32 faces the end of tube 6 allowing fluid flow only into tube 6.

I claim:

1. An instant tissue moistening device for use with a toilet flush tank including an inlet valve having a toilet bowl refill outlet, said device comprising:

a reservoir adapted to be mounted in the flush tank, said reservoir including an inlet tube adapted to be connected to the toilet bowl refill outlet and an outlet tube, said outlet tube having a check valve positioned in the reservoir and permitting fluid flow from said reservoir through said outlet tube;

a dispenser adapted to be positioned external of the flush tank, said dispenser including a cavity having a fluid inlet connected to said outlet tube and a fluid outlet, said dispenser further including a diaphragm pump communicating with said fluid outlet, said pump having, in series, a diaphragm, a resilient member, and a check valve providing a pump outlet, such that movement of said resilient member to a first position causes fluid in said cavity to flow past said diaphragm and through said pump check valve, and return of said resilient member from said first position to the rest position causes said diaphragm and pump check valve to prevent fluid flow into said pump outlet thereby drawing fluid from said reservoir and into said cavity; and an absorbent pad mounted over said pump check valve so as to absorb fluid exiting said pump for use in moistening tissue.

2. The instant tissue moistening device of claim 1, wherein said reservoir further includes an overflow in communication with said flush tank.

3. The instant tissue moistening device of claim 1, wherein said reservoir further includes a hanger for mounting said reservoir on an upper edge of the flush tank.

* * * * *